United States Patent [19]
Schacter
[11] 4,198,085
[45] Apr. 15, 1980

[54] GATE LATCH

[75] Inventor: Robert I. Schacter, Hidden Hills, Calif.

[73] Assignee: Max Geldin, Studio City, Calif. ; a part interest

[21] Appl. No.: 930,347

[22] Filed: Aug. 2, 1978

[51] Int. Cl.[2] ..... E05C 3/06
[52] U.S. Cl. ..... 292/217; 292/236
[58] Field of Search ..... 292/54, 202, 213, 217, 292/230, 231, 236, 238

[56] References Cited

U.S. PATENT DOCUMENTS

| | | | |
|---|---|---|---|
| 196,718 | 10/1877 | Stephens | 292/238 |
| 484,752 | 10/1892 | Hoffman | 292/54 |
| 728,087 | 5/1903 | Deardorff | 292/54 |
| 842,046 | 1/1907 | Williams | 292/54 |
| 1,115,271 | 10/1914 | Aronson | 292/54 UX |
| 1,221,954 | 4/1917 | Arnold | 292/238 |
| 1,482,652 | 2/1924 | Klepper | 292/54 |
| 2,293,042 | 8/1942 | Bush et al. | 292/54 X |
| 2,818,294 | 12/1957 | Killough | 292/54 |
| 3,148,904 | 9/1964 | Hess | 292/217 X |
| 3,325,204 | 6/1967 | Case | 292/236 X |

FOREIGN PATENT DOCUMENTS

| | | | |
|---|---|---|---|
| 6260 | of 1927 | Australia | 292/54 |
| 479176 | 12/1951 | Canada | 292/238 |
| 97020 | 10/1939 | Sweden | 292/238 |
| 148706 | 2/1955 | Sweden | 292/54 |

*Primary Examiner*—J. Franklin Foss
*Attorney, Agent, or Firm*—Max Geldin

[57] ABSTRACT

Gate latch for fastening a vertically hinged two-way swinging gate, and arranged to be manually released easily from either side of the closed gate to permit swinging movement and opening of the gate in either direction. The latch comprises in one embodiment a pair of pivotally mounted latch members which in their normal lowered position engage a vertical end member of the gate to fasten the gate in locked position, and a pivoted lever mounted transversely across the latch members, and having depending lugs arranged to selectively engage the latch members, so that when the lever is pressed down from one side of the gate, the latch member on the same side of the gate will be pivoted upwardly out of engagement with the end member on the gate, to permit the gate to swing outwardly in one direction, and when the lever is moved upwardly from the same side of the gate, the latch member on the opposite side of the gate will be pivoted upwardly out of engagement with the gate end member to permit the gate to swing outwardly in the opposite direction.

9 Claims, 8 Drawing Figures

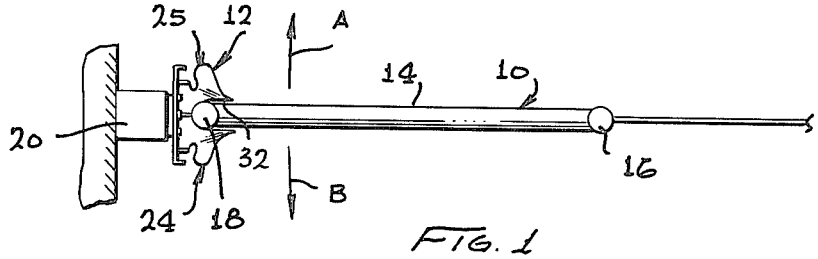
FIG. 1
FIG. 2
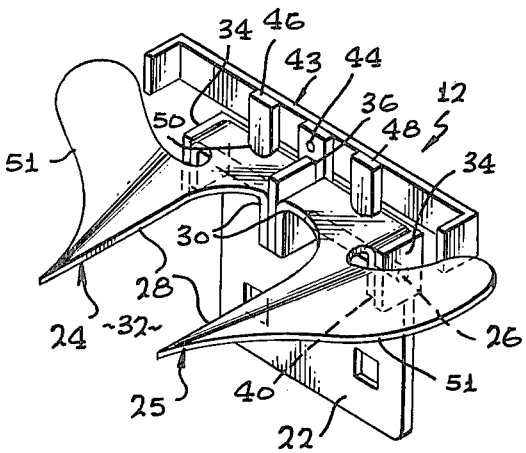
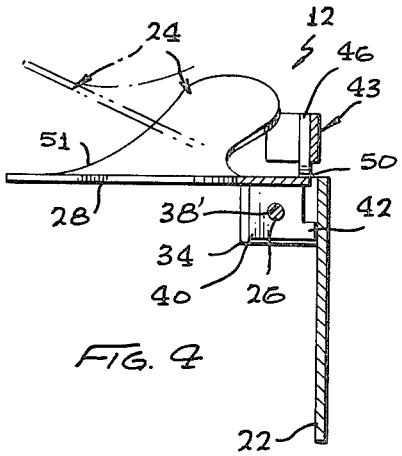
FIG. 4
FIG. 3
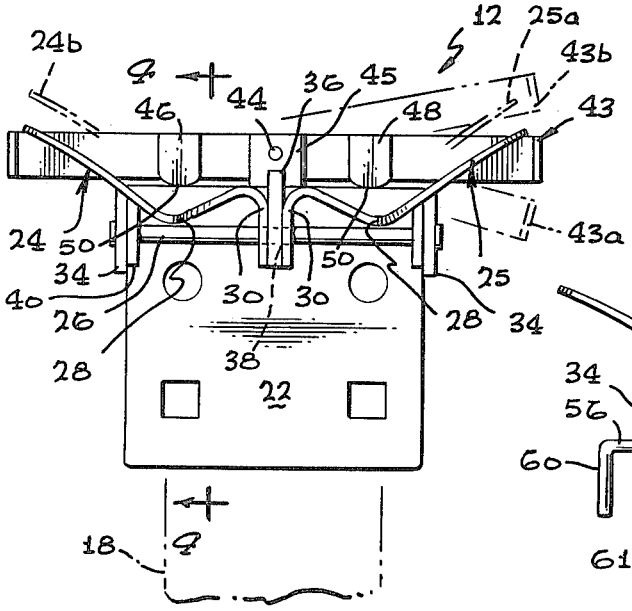
FIG. 5
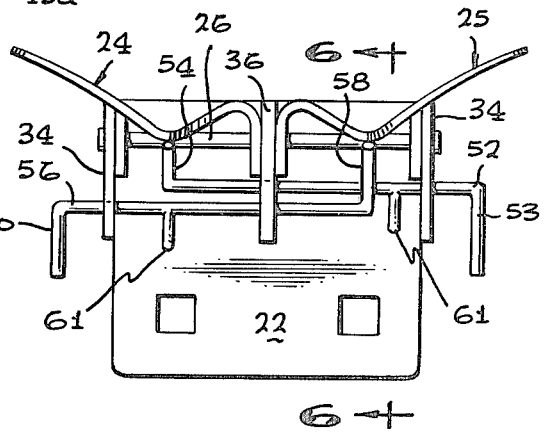

FIG. 6
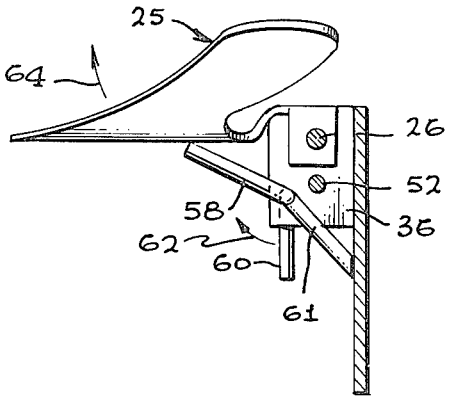
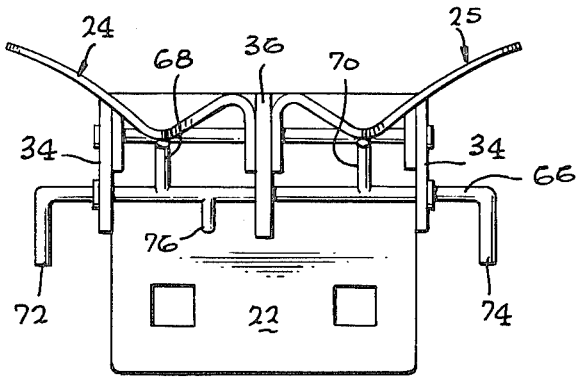
FIG. 7
FIG. 8
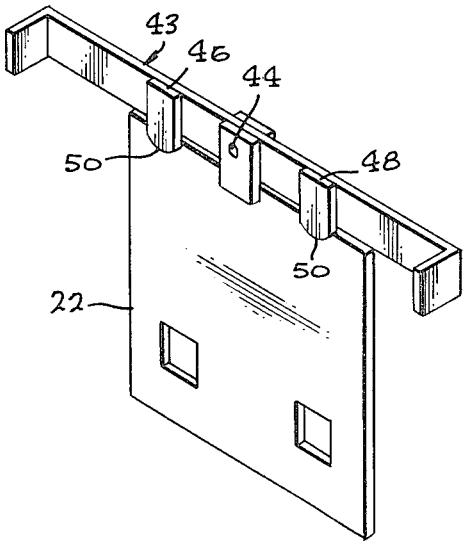

GATE LATCH

BACKGROUND OF THE INVENTION

This invention relates to latches for gates and similar closures and more particularly to an improved gate latch for two-way swinging gates and similar closures.

Gate latches having a pair of upwardly pivoting latch members or leaves, and which in their normal lowered position are adapted to engage a vertical end member of a swinging gate, to maintain the gate in locked position, are well known. Each of the latch members can be pivoted manually upward from each side of the gate to permit the gate to swing in one direction or the other.

However, if one approaches the gate from one side and wishes to unlatch the gate so that it will swing outwardly in the opposite direction, it is necessary to place the hand across the gate to the opposite latch member or leaf to manually raise that leaf to permit outward swinging of the gate. This is awkward and burdensome, and particularly if one is carrying a package and the freedom of movement of his hands is thus restricted, the ability to lift the opposite latch member or leaf on the opposite side of the gate to open the gate in that direction is particularly difficult.

Illustrative of the prior art are U.S. Pat. Nos. 3,043,617; 2,860,903; and 2,809,063.

One object of the present invention accordingly is to provide a gate latch of simple design and construction, which can be operated from either side of a two-way swinging gate to permit easy release of the latch from one side of the gate so as to permit the gate to swing freely in either direction.

Another object of the invention is to provide an improved gate latch for fastening a vertically hinged two-way swinging gate and which includes a pair of pivotally mounted latch members which in their normal lowered position engage a vertical end member of the gate to fasten the gate in locked position, and including a pivotally mounted means for engaging one or the other or both of the latch members from one side of the gate, for manually selectively raising the latch members on one or both sides of the gate to permit swinging movement of the gate in either direction.

SUMMARY OF THE INVENTION

The gate latch of the invention for fastening a vertically hinged two-way swinging gate comprises a pair of pivotally mounted latch members or leaves which in their normal lowered position engage a vertical end member of the gate to fasten the gate in locked position. The gate can be swung in either direction by upward pivotal movement of one or the other of the pivotally mounted leaves.

According to a preferred embodiment there is provided a pivoted lever mounted transversely across the latch members and having depending lugs arranged to selectively engage the latch members so that when the lever is pressed down from one side of the gate, the latch member on the same side of the gate will be pivoted upwardly out of engagement with the end member on the gate to permit the gate to swing outwardly in one direction, and when such lever is pushed upwardly from the same side of the gate, the latch member on the opposite side of the gate will be pivoted upwardly out of engagement with the gate end member to permit the gate to swing outwardly in the opposite direction.

According to another embodiment, lever means in the form of a transversely pivoted bar, mounted below the latch members or leaves and having upwardly extending lugs adapted to engage the leaves can be provided, whereby a pivotal or twisting movement of the bar from either side of the gate will pivot both leaves upwardly out of engagement with the gate end member to permit swinging movement of the gate in either direction.

DESCRIPTION OF THE DRAWINGS

The invention will be more clearly understood by reference to the drawings below wherein:

FIG. 1 is a plan view of a two-way swinging gate maintained in locked position by the gate latch of the invention;

FIG. 2 is a perspective view of a preferred embodiment of gate latch according to the invention;

FIG. 3 is a front elevation of the gate latch of FIG. 2;

FIG. 4 is a partial side elevation in section of the gate latch of FIG. 2, taken on line 4—4 of FIG. 3;

FIG. 5 is a front view illustrating another embodiment of the gate latch of the invention;

FIG. 6 is a side elevation sectional view, taken on line 6—6 of FIG. 5;

FIG. 7 illustrates still another embodiment of gate latch of the invention; and

FIG. 8 is an elevational perspective view of a modification in the form of a subcombination of the invention structure.

DESCRIPTION OF PREFERRED EMBODIMENTS

Referring to FIGS. 1 to 4 of the drawings, there is shown a gate 10 which is adapted to be maintained in fixed position by a gate latch 12 according to the invention. Gate 10 comprises a frame 14 which is mounted for swinging movement in either direction on a vertical axis formed by one vertical end member or frame member 16 of the gate. The gate has an opposite vertical end member or frame member 18 which is engaged by the the latch 12.

The frame member 18 in the closed position of the gate is disposed adjacent a gate post 20 and the gate latch 12 is mounted on the gate post. The gate latch 12 comprises a mounting bracket or plate 22 in the form of a flat plate which is secured by suitable means such as fasteners to the gate post 20. A pair of oppositely disposed leaves 24 and 25 are pivotally mounted on a pivot rod 26, the leaves 24 and 25 having oppositely disposed inner edges 28 spaced from each other and curving inwardly and downwardly at 30, defining a space 32 for receiving the vertical frame member 18 of the gate.

The pivot rod 26 is mounted for pivotal movement on a pair of end brackets 34 mounted on opposite sides of plate 22. Pivot rod 26 also is supported by a central bracket 36 also connected to the frame 22. The downwardly curved inner postions 30 of the leaves 24 and 25 are apertured at 38 to receive the pivot rod 26 on opposite sides of the central bracket 36.

Leaves 24 and 25 each also carry at their outer portion a downwardly extending lug 40 positioned adjacent the end bracket 34. Lugs 40 also are apertured at 38' to receive the pivot rod 26. The lugs 40 each carry at their rear surface a dog or stop 42, which is adapted to make contact with the face of the plate 22 when the leaves are pivoted to their downward horizontal normal position for latching the gate as seen in FIG. 1. Either or both of the leaves 24 and 25 can be pivoted or swung upwardly on pivot rod 26 from their normal horizontal full line position shown in FIG. 4 to their dotted line position in FIG. 4, and when such leaf or leaves are raised sufficiently, the frame member 18 of the gate can be swung in either direction as indicated by the arrows A and B in FIG. 1 to open the gate.

A lever 43 is pivotally mounted transversely of the leaves 24 and 25, and to the rear thereof, on a pivot pin 44 to pivot the lever on an axis perpendicular to the pivot rod 26. The lever 43 is mounted longitudinally of the pivot rod 26 and transversely across the rear portions of the leaves. Pivot pin 44 is positioned on a central bracket 45 mounted on top of the large bracket or plate 22. There are connected to the lever 43 a pair of lugs 46 and 48 positioned on opposite sides of pivot pin 44. The lugs 46 and 48 have a depending curved portion 50 which in the normal horizontal position of leaves 24 and 25, make contact with the rear portions of such leaves to the rear of pivot rod 26.

It will be noted that when the lever 43 is pressed down on one side to the position 43*a* shown in dotted lines in FIG. 3, the leaf 25 on the same side is raised or opened as indicated by dotted lines 25*a*, and when sufficiently raised to an essentially vertical position will permit end member 18 of the gate to swing clear of the latch and the gate 10 can open or be swung outwardly from the same side of the latch, in the direction indicated by arrow A in FIG. 1. Raising of the lever 43 from position 43*a* to its normal horizontal position will permit leaf 25 to drop back to its normal horizontal locking position shown in FIG. 3.

When the lever 43 on the same side is raised to the position 43*b* shown in dotted lines in FIG. 3, the leaf 24 on the opposite side of the latch is raised or opened as indicated by dotted lines 24*b*, and when sufficiently raised to an essentially vertical position it will permit end member 18 of the gate to clear the latch to allow gate 10 to swing in the opposite direction indicated by arrow B in FIG. 1. Lowering the lever 43 from its position shown at 43*b* to its normal horizontal position in FIG. 3 will permit leaf 24 to drop back to its normal horizontal locking position shown in FIG. 3.

When the gate is swung back from an open position on either side of the latch, back to the gate latch 12, movement of the gate against the outer curved portion 51 of the leaf 24 or 25, will raise or pivot upwardly the respective leaves to permit the vertical end member 18 of the gate to be received in the locked position in the space 32 between the leaves, and when the gate is in this locked position, the leaves have dropped back to their normal horizontal locking position, and the gate is now securely latched.

It will accordingly be seen, viewing FIGS. 1 and 3, that the gate 10 can be opened in either direction from one side or the opposite side of the latch 12, and particularly, that one approaching the latch from one side of the gate, e.g. from the right in FIG. 3, need not have to reach over the latch with his hand to the opposite side of the gate, that is, to the far left in FIG. 3, in order to lift the leaf on the opposite side of the gate and open the latch to raise the gate and swing it in the opposite direction, but need only raise the lever, e.g. to the position shown at 43*b* on one side of the latch to raise the leaf on the other side of the latch and cause the gate to swing in the opposite direction as indicated by arrow B in FIG. 1.

In a modification of the invention device according to FIGS. 5 and 6, instead of the pivoted lever 43 for actuating the leaves 24 and 25, there are provided a pair of rotatable rods 52 and 56, each parallel to pivot rod 26. Rod 52 is mounted for rotational movement on one of the brackets 34 and the central bracket 36, and has an upwardly extending end 54 which is arranged to make contact with the leaf 24, and a handle 53 at its outer end.

The other rotatable rod 56, of the same structure as rod 52 is mounted for rotation in the opposite end bracket 34 and in the central bracket 36, and has an upwardly extending end 58 arranged to make contact with the other leaf 25, and is provided with a handle 60, disposed on the opposite side of the plate 22 from handle 53.

In the normal position of the rotatable rods 52 and 56, corresponding to the closed latch position with the leaves 24 and 25 in lowered position as seen in FIG. 5, the upwardly extending end portions 54 and 58 thereof make contact with the respective leaves 24 and 25. In such normal position, stops 61 are provided on each of rods 52 and 56, to make contact with the plate 22 and maintain end portions 54 and 58 of rods 52 and 56 in contact with the leaves to prevent further lowering thereof. When handle 60 of the rod 56 is rotated counterclockwise so as to rotate the end portion 58 counterclockwise, as shown by the arrow 62 in FIG. 6, the leaf 25 can be rotated upwardly as shown by arrow 64 until it permits clearance and movement of the end member 18 and the gate 10 in a swinging direction as indicated by arrow A in FIG. 1. When the opposite handle 53 of the rotatable rod 52 is rotated clockwise to rotate the end member 54 in the same direction, leaf 24 is raised and permits movement of end member 18 and the gate 10 from the latched position outwardly in the direction indicated by arrow B in FIG. 1.

It is thus seen that one approaching the gate and the latch from the right as indicated in FIG. 5, can raise the leaf 25 manually with his fingers, if he desires the gate to swing toward him as indicated by arrow A in FIG. 1, but in the event the gate is to be unlatched and swung in the opposite direction as indicated by arrow B in FIG. 1, he need not reach over the opposite side of the latch to raise leaf 24, but need only rotate the rod 52 by means of the handle 53 and swing the gate in the opposite direction as indicated by arrow B. The same situation applies where one approaches the gate from the left, viewing FIG. 5, so that rotatable rod 56 can be rotated by means of the handle 60 to raise the opposite leaf 25, and rotate the gate in the direction of arrow A, without having to reach over the latch to lift the leaf 25 manually.

According to a further modification, as seen in FIG. 7, there can be provided a single rod 66 in place of the two rods 52 and 56, containing two upwardly bent portions 68 and 70, similar to 54 and 58, and adapted to contact the leaves 24 and 25, such rods having handles 72 and 74 at both ends, whereby the handle at either end can be rotated or twisted to simultaneously raise both leaves 24 and 25 for unlatching the gate, to permit the gate to swing in either direction. Stop 76 connected to rod 66 makes contact with the plate 22 and maintains contact of portions 68 and 70 with leaves 24 and 25 in the normal closed position of the latch, to prevent further lowering of the leaves.

FIG. 8 is a modification comprised of the subcombination of frame 22 having mounted thereon the pivotal lever 43 having the lugs 46 and 48 connected to the lever on the opposite sides of the pivot pin 44. This subcombination structure can be slipped behind the conventional gate latch comprised only of the leaves 24 and 25 (see FIGS. 1 and 2) mounted on a pivot rod such as 26, so that the lugs 46 and 48 make contact with the rear portions of the leaves, whereby such leaves can be selectively raised by actuation of the lever 43 as above described, to raise the leaves and permit the gate to be opened and swung in either direction from the latch.

From the foregoing, it is seen that there is provided according to the invention a simple inexpensive latching mechanism for a two-way swinging gate which permits the gate to be swung selectively in one direction or the other, by a simple movement of a lever, or rotation or twisting of an actuating rod, from one side of the gate, without the necessity for reaching over the gate and the latch in order to open the latch and swing the gate in the opposite direction.

It will be understood that various modifications and changes can be made in the invention structure, and accordingly the invention is not to be taken as limited except by the scope of the appended claims.

What is claimed is:

1. A gate latch for a vertically hinged two-way swinging gate, said gate latch being mounted on a gate post, comprising a pair of latch members positioned adjacent each other and adapted to engage therebetween a vertical end member of said gate to maintain same in latched position, said latch members each being in the form of leaves having an outer curved edge, and being inwardly shaped to provide a space between said leaves to receive said vertical end member of said gate in latched position, and support means mounting said leaves in a normal substantially horizontal latching position, means for pivotally mounting each of said leaves for rotation thereof from a latched position upwardly to an unlatched position, said means comprising a pivot rod positioned transversely across said leaves, a mounting plate, means mounting said pivot rod on said mounting plate, latch actuating means mounted transversely of said latch members, said latch actuating means comprising an actuating lever mounted on said mounting plate above said leaves in their normal substantially horizontal position, a pivot pin for said lever to pivot said lever on an axis perpendicular to the axis of said pivot rod, contact members on said actuating lever and adapted to contact the rear portion of said leaves to the rear of said pivot rod, and to selectively rotate one or the other of said leaves upwardly to an unlatched position by manual actuation of said lever upwardly or downwardly from either side of said gate latch.

2. A gate latch as defined in claim 1, said lever being mounted longitudinally of said pivot rod and transversely across the rear portions of said leaves, said contact members on said actuating lever being lugs mounted on opposite sides of said pivot pin and having a lower end portion for contacting the respective leaves at said rear portions thereof for said selective rotation of said leaves.

3. A gate latch as defined in claim 2, said support means for mounting said leaves in horizontal position comprising stops mounted on the rear portion of each of said leaves and adapted to make contact with said mounting plate when said leaves are in said horizontal latching position.

4. A gate latch for a vertically hinged two-way swinging gate, said gate latch being mounted on a gate post, comprising a pair of latch members positioned adjacent each other and adapted to engage therebetween a vertical end member of said gate to maintain same in latched position, said latch members each being in the form of leaves having an outer curved edge, and being inwardly shaped to provide a space between said leaves to receive said vertical end member of said gate in latched position, and support means mounting said leaves in a normal substantially horizontal latching position, means for pivotally mounting each of said leaves for rotation thereof from a latched position upwardly to an unlatched position, said means comprising a pivot rod positioned transversely across said leaves, a mounting plate, means mounting said pivot rod on said mounting plate, latch actuating means mounted transversely of said latch members, said latch actuating means comprising a pair of rotatable rods on said mounting plate, a handle mounted in each of said rotatable rods at opposite ends of said gate latch, the handle on the respective rotatable rods being actuatable for rotating the respective rotatable rods from opposite sides of said gate latch, each of said rotatable rods having an end portion forming a contact member adapted to contact the leaf on the opposite side of said gate latch remote from the handle thereon, to rotate said leaf to an upward unlatched position on actuation of said handle from one side of said gate latch and said gate.

5. A gate latch as defined in claim 4, said support means for mounting said leaves in horizontal position comprising stops mounted on said rotatable rods and adapted to make contact with said mounting plate when said leaves are in horizontal latching position.

6. A gate latch for a vertically hinged two-way swinging gate, said gate latch being mounted on a gate post, comprising a pair of latch members positioned adjacent each other and adapted to engage therebetween a vertical end member of said gate to maintain same in latched position, said latch members each being in the form of leaves having an outer curved edge, and being inwardly shaped to provide a space between said leaves to receive said vertical end member of said gate in latched position, and support means mounting said leaves in a normal substantially horizontal latching position, means for pivotally mounting each of said leaves for rotation thereof from a latched position upwardly to an unlatched position, said means comprising a pivot rod positioned transversely across said leaves, a mounting plate, means mounting said pivot rod on said mounting plate, latch actuating means mounted transverely of said latch members, said latch actuating means comprising a rotatable rod mounted parallel to said pivot rod on said mounting plate and extending transversely of said leaves to opposite sides of said gate latch, a handle mounted at each end of said rotatable rod on opposite sides of said gate latch, and upwardly extending contact members on said rod and adapted to contact each of said leaves to simultaneously rotate said leaves upwardly to an unlatched position by rotation of the handle on either end of said rotatable rod.

7. A gate latch as defined in claim 6, said support means for mounting said leaves in horizontal position comprising a stop mounted on said rotatable rod and adapted to make contact with said mounting plate when said leaves are in said horizontal latching position.

8. Actuating means for a gate latch for a vertically hinged two-way swinging gate, said gate latch including a pair of leaves pivotally mounted on a pivot rod for rotation thereof from a latched position upwardly to an unlatched position; comprising a mounting plate, an actuating lever mounted on said mounting plate, a pivot pin for said lever, contact members on said actuating lever and adapted to contact said leaves at the rear portions thereof to the rear of said pivot rod, for selective rotation of said leaves upwardly to an unlatched position by manual actuation of said lever upwardly or downwardly from either end of said lever.

9. Actuating means for a gate latch as defined in claim 8, said contact members on said actuating lever being lugs mounted on opposite sides of said pivot pin and having a lower end portion for contacting the respective leaves at the rear portions thereof for said selective rotation of said leaves.

* * * * *